US011299911B2

(12) United States Patent
Geenens et al.

(10) Patent No.: US 11,299,911 B2
(45) Date of Patent: Apr. 12, 2022

(54) SUPPLEMENTAL DOOR LOCK AND ALERT SYSTEM

(71) Applicant: CAMPUS SAFETY PRODUCTS, LLC, Raleigh, NC (US)

(72) Inventors: David Linn Geenens, Lenexa, KS (US); Jeffrey Lynn Perry, Overland Park, KS (US)

(73) Assignee: Campus Safety Products, LLC, Raleigh, NC (US)

( * ) Notice: Subject to any disclaimer, the term of this patent is extended or adjusted under 35 U.S.C. 154(b) by 209 days.

(21) Appl. No.: 16/354,485

(22) Filed: Mar. 15, 2019

(65) Prior Publication Data

US 2019/0284838 A1 Sep. 19, 2019

Related U.S. Application Data

(60) Provisional application No. 62/644,151, filed on Mar. 16, 2018, provisional application No. 62/644,144, filed on Mar. 16, 2018, provisional application No. 62/644,115, filed on Mar. 16, 2018.

(51) Int. Cl.

| | |
|---|---|
| ***E05B 45/06*** | (2006.01) |
| ***E05C 19/00*** | (2006.01) |
| ***E05C 1/04*** | (2006.01) |

(52) U.S. Cl.

CPC ..... *E05B 45/06* (2013.01); *E05C 1/04* (2013.01); *E05C 19/003* (2013.01); *E05B 2045/064* (2013.01); *E05B 2045/0665* (2013.01); *E05Y 2900/132* (2013.01)

(58) Field of Classification Search

CPC ..... E05B 2045/064; E05B 2045/0665; E05B 2063/0039; E05B 45/06; E05B 53/001; E05C 19/003; E05C 1/006; E05C 1/04; E05C 1/06

See application file for complete search history.

(56) References Cited

U.S. PATENT DOCUMENTS

| | | | | |
|---|---|---|---|---|
| 10,214,948 | B2 | 2/2019 | Richmond | |
| 2014/0217754 | A1* | 8/2014 | Taylor | E05C 19/184 292/288 |
| 2015/0159401 | A1* | 6/2015 | Patrick | G07C 9/00571 292/137 |

(Continued)

*Primary Examiner* — Sisay Yacob

(74) *Attorney, Agent, or Firm* — James G. Passé; Passé Intellectual Property, LLC

(57) ABSTRACT

An alert system configured to monitor a status of one or more supplemental door locks comprises a switch assembly and an alarm. The switch assembly is configured to detect whether one supplemental door lock is unlocked or locked and includes a switch, an indicator, and a communication element. The switch is to be coupled to a locking component of the supplemental door lock. The switch is configured to sense a position of the locking component and generate an electronic signal or data. The indicator is configured to provide a first indication of a status of the supplemental door lock. The communication element is configured to receive the electronic signal or data from the switch and generate a wireless signal that corresponds to the electronic signal or data. The alarm is configured to generate an audible or visible alarm when the switch assembly detects that the supplemental door lock is locked.

2 Claims, 4 Drawing Sheets

(56) References Cited

U.S. PATENT DOCUMENTS

| | | | | |
|---|---|---|---|---|
| 2016/0163140 | A1* | 6/2016 | Lagimodiere | G07C 9/00912 340/5.7 |
| 2016/0186470 | A1* | 6/2016 | Finley | E05B 45/06 292/339 |
| 2016/0215538 | A1* | 7/2016 | Pistone | E05C 17/443 |
| 2017/0211301 | A1* | 7/2017 | Richmond | E05C 5/00 |
| 2017/0278363 | A1* | 9/2017 | Webb | G07C 9/38 |
| 2018/0148960 | A1* | 5/2018 | Finley | E05C 19/003 |
| 2018/0340352 | A1* | 11/2018 | Compton | E05B 55/00 |

* cited by examiner

SUPPLEMENTAL DOOR LOCK AND ALERT SYSTEM

RELATED APPLICATIONS

The current patent application is a utility patent application which claims priority benefit with regard to all common subject matter to U.S. Provisional Application Ser. No. 62/644,151, titled "SUPPLEMENTAL DOOR LOCK", filed Mar. 16, 2018; U.S. Provisional Application Ser. No. 62/644,144, titled "SUPPLEMENTAL DOOR LOCK AND BREACH TOOL", filed Mar. 16, 2018; and U.S. Provisional Application Ser. No. 62/644,115, titled "SUPPLEMENTAL DOOR LOCK AND ALERT SYSTEM", filed Mar. 16, 2018. The listed earlier-filed provisional applications are hereby incorporated by reference in their entireties into the current patent application.

FIELD OF THE INVENTION

Embodiments of the current invention relate to door barriers, door locks, and similar devices. More particularly, the invention relates to alert systems which monitor a status of door barriers, door locks, and similar devices.

DESCRIPTION OF THE RELATED ART

Mass shootings and other attacks in schools, offices, and other buildings are occurring more frequently. To minimize deaths and injuries during such attacks, students, teachers, and other occupants are trained to hide behind locked doors until law enforcement arrives. Unfortunately, many schools and other buildings don't have lockable doors or have locks that are easy to circumvent.

To provide better protection against such attacks, many types of supplemental door locks, barriers, and barricades have been developed. Unfortunately, some of these devices are too flimsy or otherwise easy to circumvent; some require special knowledge to deploy; some can't be deployed quickly enough; some have stand-alone components that must be stored in closets or on shelves when not in use and then retrieved and deployed during emergencies; and/or some do not comply with fire and safety codes.

In addition, schools, offices, and other buildings may not have alarms or alert systems that notify law enforcement authorities outside the building or security personnel and administrators within the building when an emergency situation arises.

This background discussion is intended to provide information related to the present invention which is not necessarily prior art.

SUMMARY OF THE INVENTION

Embodiments of the current invention solve the above-mentioned problems and provide an improved supplemental door lock for securely locking a door during emergencies and an alert system to monitor a status of the supplemental door lock. The supplemental door lock is designed to be installed on the inside face of a door and an adjacent floor and is quickly and easily shiftable between an unlocked position in which the door may freely open (if no other locks or latches are deployed) and a locked position to prevent an attacker, intruder, etc. from opening the door. The supplemental door lock is fabricated from strong and durable materials; is nearly impossible to circumvent; is easy to install; has no unattached components that must be stored when not in use; can be deployed in seconds by anyone with no training; and complies with all known fire and safety codes.

The alert system includes components that couple to the supplemental door lock and directly monitor its status by detecting a position of the locking component. If the alert system detects that the locking component is in the locked position, then it generates an alarm and alerts law enforcement authorities.

An embodiment of the alert system broadly comprises a switch assembly and an alarm. The switch assembly is configured to detect whether one supplemental door lock is unlocked or locked and includes a switch, an indicator, and a communication element. The switch is to be coupled to a locking component of the supplemental door lock. The switch is configured to sense a position of the locking component and generate an electronic signal or data that varies according to the position of the locking component. The indicator is configured to provide a first indication of a status of the supplemental door lock, wherein the first indication varies according to whether the supplemental door lock is unlocked or locked. The communication element is configured to receive the electronic signal or data from the switch and generate a wireless signal that corresponds to the electronic signal or data. The alarm is configured to generate an audible or visible alarm when the switch assembly detects that the supplemental door lock is locked.

Another embodiment of the current invention provides an alert system configured to monitor statuses of a plurality of supplemental door locks. The alert system broadly comprises a plurality of switch assemblies and a plurality of alarms. Each switch assembly is configured to detect whether one supplemental door lock is unlocked or locked and includes a switch, an indicator, and a communication element. The switch is to be coupled to a locking component of the supplemental door lock. The switch is configured to sense a position of the locking component and generate an electronic signal or data that varies according to the position of the locking component. The indicator is configured to provide a first indication of a status of the supplemental door lock, wherein the first indication varies according to whether the supplemental door lock is unlocked or locked. The indicator is also configured to provide a second indication of an alarm situation in which at least one other switch assembly has detected that its corresponding supplemental door lock is locked. The communication element is configured to receive the electronic signal or data from the switch and generate a wireless signal that corresponds to the electronic signal or data. Each alarm is configured to generate an audible or visible alarm when one of the switch assemblies detects that its corresponding supplemental door lock is locked.

Yet another embodiment of the current invention provides supplemental door lock and alert system broadly comprising a supplemental door lock and an alert system. The supplement door lock includes a door-mounted component and a floor-mounted component. The door-mounted component is configured to be mounted on a door adjacent to a lower edge thereof and includes a locking assembly for locking the supplemental door lock with a hinge pin, a locking blade, and a locking post. The hinge pin is configured to be rotated between an unlocked position and a locked position. The locking blade includes a tab along a first edge of the locking blade such that the tab is attached to the hinge pin. The locking blade is configured to travel downward into a locking groove when the hinge pin is rotated from the unlocked position to the locked position. The locking post is attached to the locking blade along a second edge opposite the hinge pin and is oriented in a vertical fashion and extends downward from the locking blade. The floor-mounted component is to be mounted on a floor in alignment with the door-mounted component when the door is in a closed position. The floor-mounted component includes a floor plate configured to attach to the floor and a slot configured to retain the locking post when the hinge pin is in the locked position.

The alert system includes a switch assembly and an alarm. The switch assembly is configured to detect whether one supplemental door lock is unlocked or locked and includes a switch, an indicator, and a communication element. The switch is to be coupled to a locking component of the supplemental door lock. The switch is configured to sense a position of the locking component and generate an electronic signal or data that varies according to the position of the locking component. The indicator is configured to provide a first indication of a status of the supplemental door lock, wherein the first indication varies according to whether the supplemental door lock is unlocked or locked. The communication element is configured to receive the electronic signal or data from the switch and generate a wireless signal that corresponds to the electronic signal or data. The alarm is configured to generate an audible or visible alarm when the switch assembly detects that the supplemental door lock is locked.

BRIEF DESCRIPTION OF THE DRAWING FIGURES

Embodiments of the current invention are described in detail below with reference to the attached drawing figures, wherein:

FIG. 1 is a perspective view of a supplemental door lock, constructed in accordance with various embodiments of the current invention, shown with a fragmentary view of a door and a fragmentary view of a floor, the supplemental door lock being implemented in its operating environment and including a door-mounted component mounted to the door and a floor-mounted component mounted to the floor, wherein the supplemental door lock is in an unlocked state;

Figure 5:
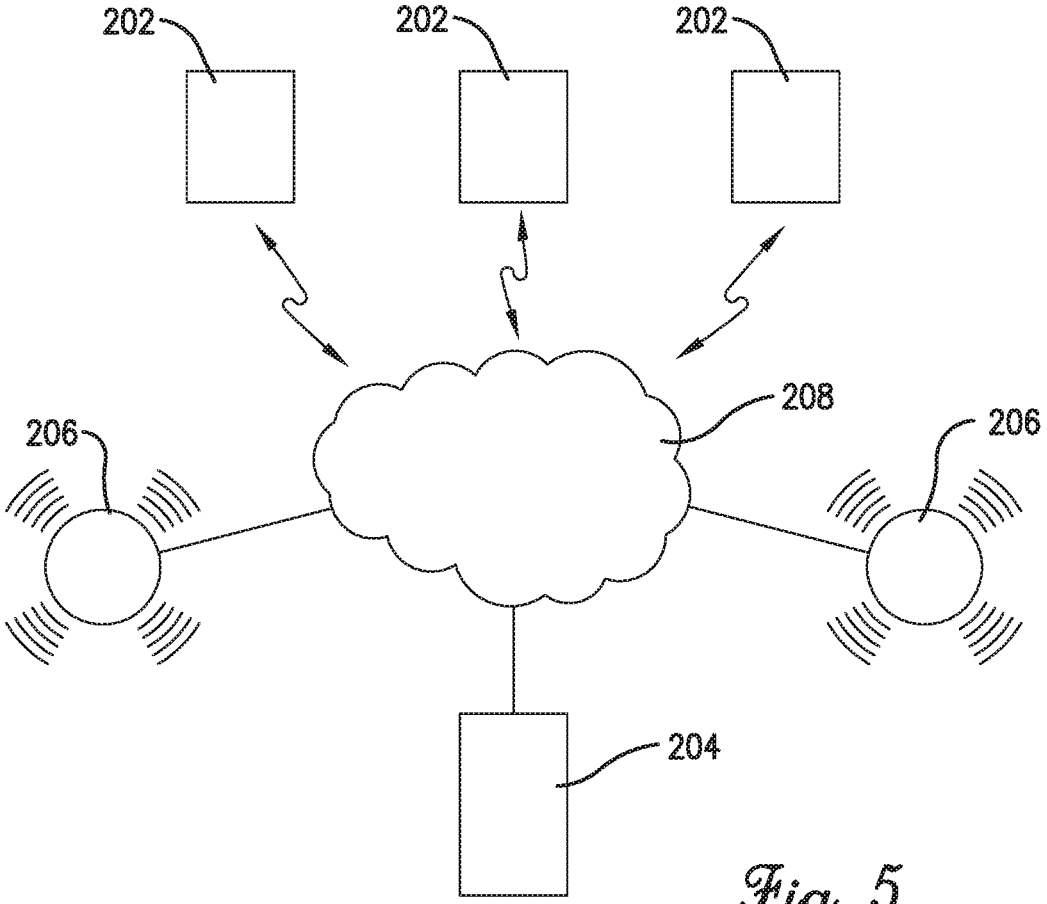
Figure 6:
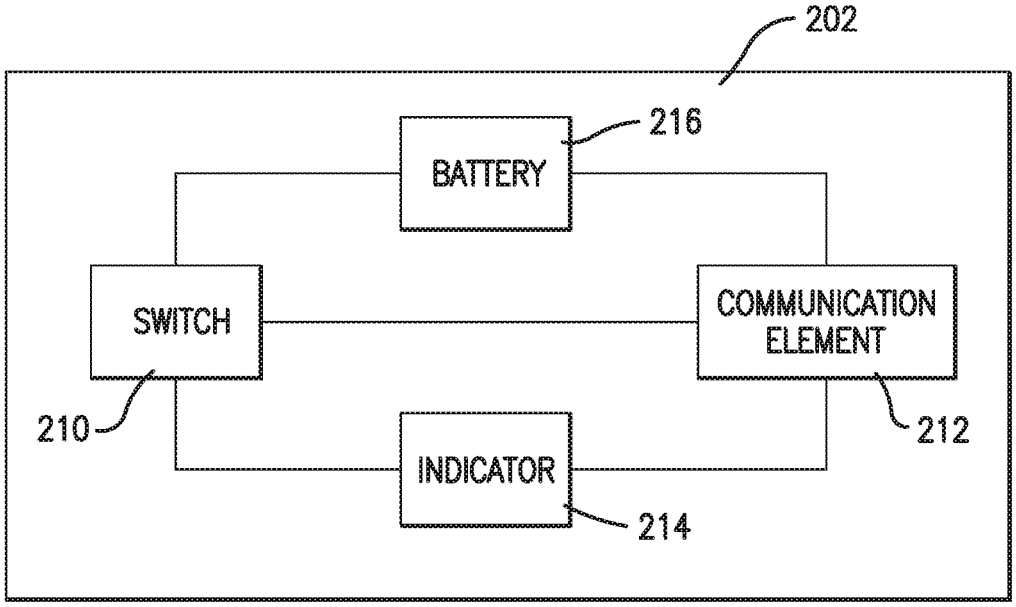

FIG. 5 is a schematic block diagram of various components of an alert system, constructed in accordance with additional embodiments of the current invention and configured to monitor a status of the supplemental door lock, the alert system comprising a plurality of switch assemblies, a server, a plurality of alarms, and a communication network; and FIG. 6 is a schematic block diagram of various components of one switch assembly.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the technology references the accompanying drawings that illustrate specific embodiments in which the technology can be practiced. The embodiments are intended to describe aspects of the technology in sufficient detail to enable those skilled in the art to practice the technology. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current invention can include a variety of combinations and/or integrations of the embodiments described herein.

Figure 1:
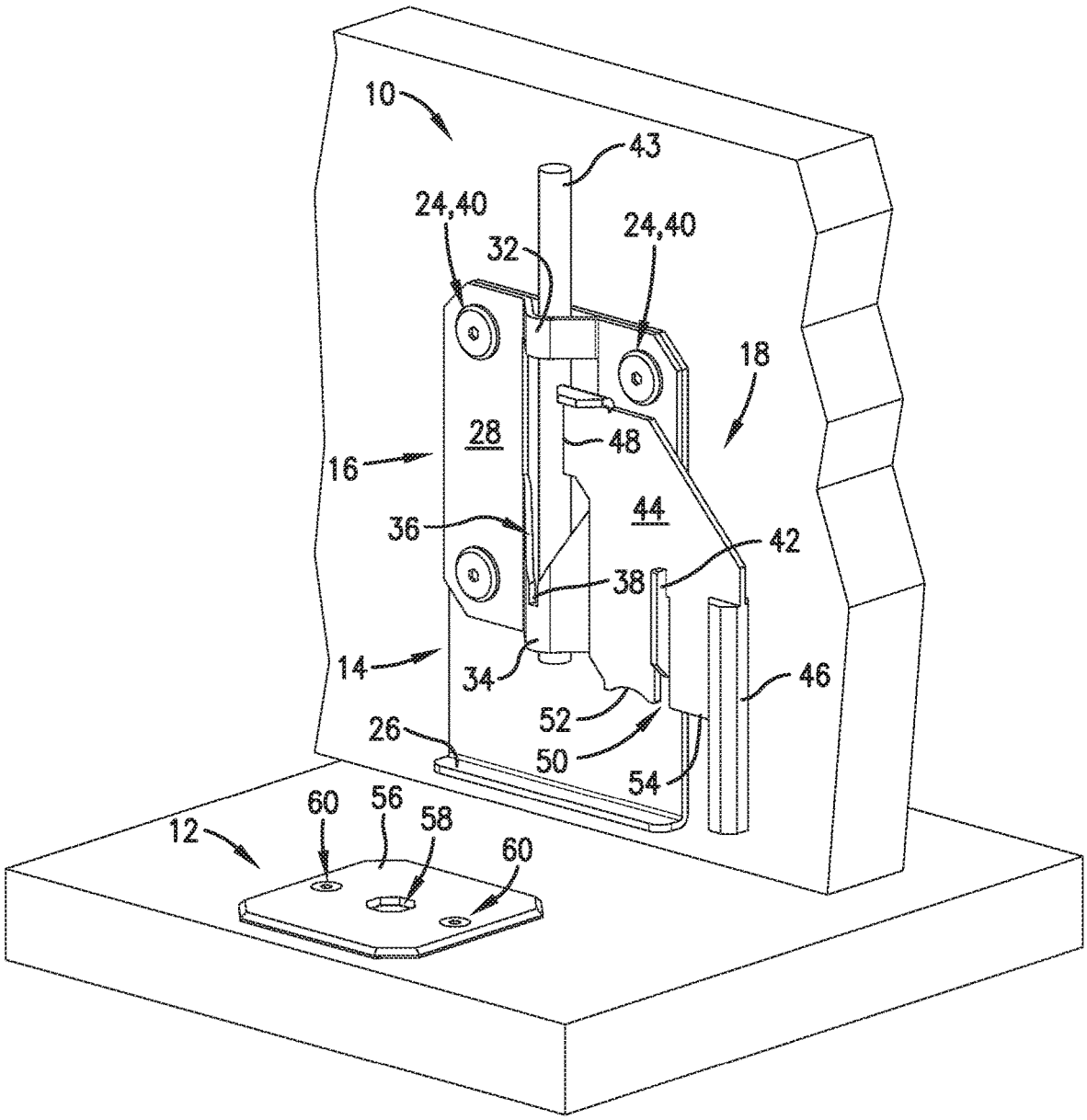
Figure 2:
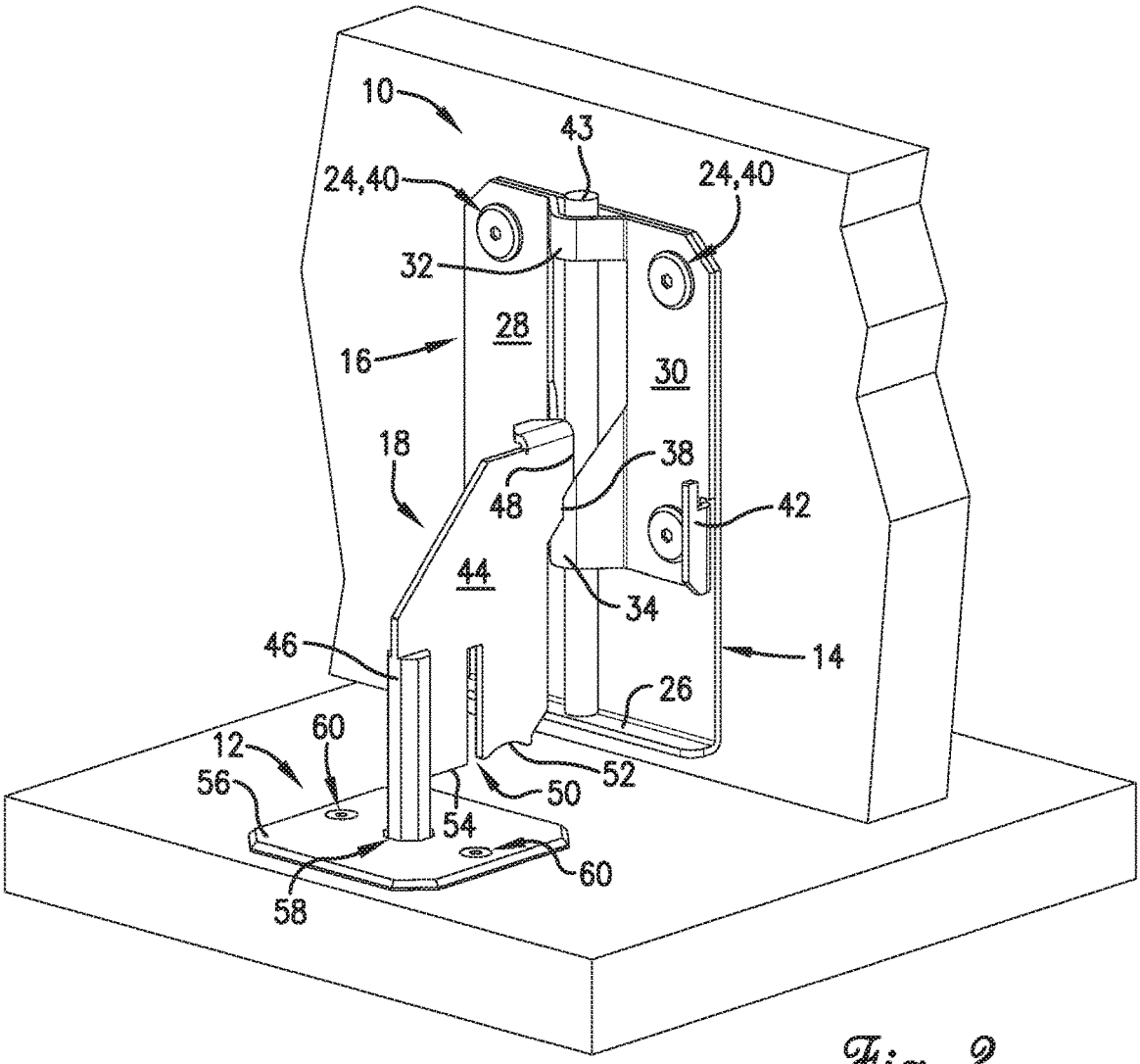
FIG. 2 is a perspective view of the supplemental door lock of FIG. 1, wherein a locking assembly of the door-mounted component is rotated such that a locking post is retained in the floor-mounted component, thereby placing the supplemental door lock in a locked state.
Figure 3:
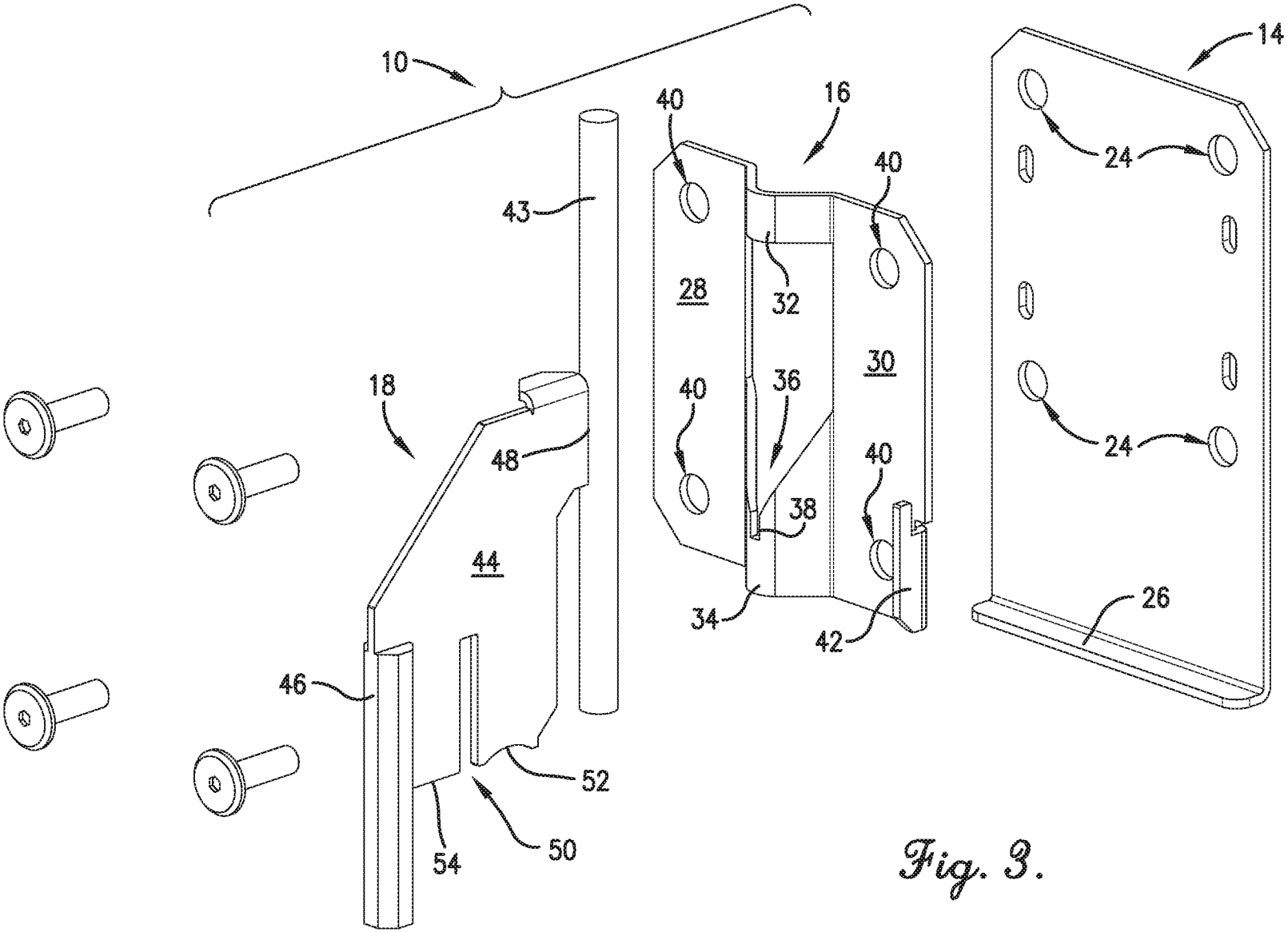
FIG. 3 is an exploded perspective view of the door-mounted component.

Referring to FIGS. 1-3, a supplemental door lock constructed in accordance with embodiments of the present invention broadly comprises a door-mounted component 10 and a floor-mounted component 12. As explained in more detail below, the supplemental door lock is shiftable between an unlocked position in which its door may freely open (if no other locks or latches are deployed) and a locked position in which the door-mounted component 10 engages the floor mounted component 12 to prevent opening of the door.

The door-mounted component 10 comprises a door mounting plate 14; an hinge plate 16; and a locking assembly 18 sandwiched between the door mounting plate 14 and the hinge plate 16. All of these components are preferably fabricated of stainless steel or other hardened metals.

The door mounting plate 14 mounts to the inside face of a door and includes several bolt-holes 24 formed in the door mounting plate 14 for receiving screws or other fasteners. A perpendicularly-extending foot 26 is formed on the lower edge of the door mounting plate 14. The purpose of the foot 26 is described below.

An exemplary embodiment of the door mounting plate 14 is approximately 8" tall, 5" wide, and 0.25" thick. An exemplary embodiment of the foot 26 extends approximately 0.625" from the lower edge of the door mounting plate. However, the door mounting plate 14 and its foot 26 may be formed in other shapes and sizes without departing from the scope of the invention.

Figure 4:
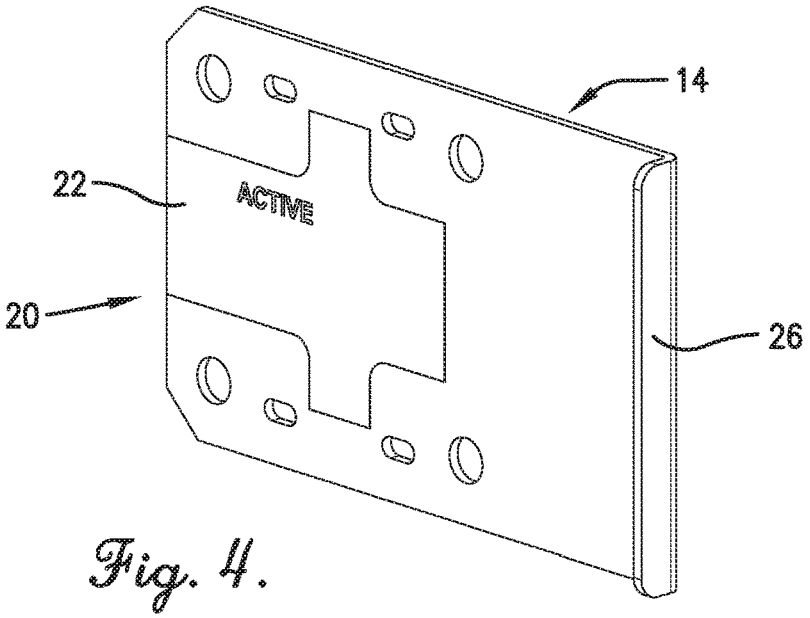
FIG. 4 is a perspective view of an alternative embodiment of a door-mounting plate of the door-mounted component.

An alternative embodiment of the door mounting plate 14 is shown in FIG. 4 and has a generally rectangular-shaped periphery with an inverted T-shaped cutout 20 and a corresponding T-shaped insert 22 that may be placed in the cutout 22. Labels or stickers, that are high contrast, high visibility, and/or reflective, with messaging such as "ACTIVE", may be applied to the insert 22 and covered by the locking assembly 18 when the supplemental door lock is in an unlocked position and exposed when the supplemental door lock is in a locked position to designate the status of the supplemental door lock.

An exemplary embodiment of the hinge plate 16 mounts over the door mounting plate 14 so as to envelop the locking assembly 18 therebetween. The hinge plate 16 includes left and right planar sections 28, 30 joined by spaced apart upper and lower bridges 32, 34. The upper and lower bridges 32, 34 create open spaces between the door mounting plate 14 and the hinge plate 16 for receiving and accommodating movement of the locking assembly 18 as described in more detail below. Each bridge 32, 34 is formed by first and second roughly planar sections that are joined by an arcuate or curved section. The first and second planar sections are positioned to form an angle of roughly 90 degrees. The lower bridge 34 includes a funnel-shaped, or V-shaped, groove 36 that terminates in a first vertical slot 38, the purpose of which are described below. Several bolt-holes 40 are formed in the hinge plate 16 and can be aligned with the bolt holes 24 in the door mounting plate 14 so that both sets of bolt holes 24, 40 can receiving the same screws or other fasteners. A support arm 42 extends from either the left or right planar sections of the hinge plate 16 to form a second vertical slot, the purpose of which is described below.

An exemplary embodiment of the hinge plate 16 is approximately 5.5" tall, 6" wide, and 0.25" thick, but it may be formed in other shapes and sizes without departing from the scope of the invention.

An exemplary embodiment of the locking assembly 18 is sandwiched between the door mounting plate 14 and the hinge plate 16 and is shiftable between unlocked and locked positions as described below. An embodiment of the locking assembly 18 includes an elongated hinge pin 43, a locking blade 44 fixed to the hinge pin 43, and a locking post 46 extending from the locking blade 44.

The hinge pin 43 is positioned underneath the upper and lower bridges 32, 34 of the hinge plate 16 and can be shifted vertically up and down and rotated relative to the door mounting plate 14 and the hinge plate 16. An embodiment of the hinge pin 43 is circular in cross-section, 0.5" in diameter, and 8.125" tall, but it may be of any size and shape.

The locking blade 44 has a tab 48 that is welded or otherwise fastened to the central portion of the hinge pin 43 such that the locking blade 44 extends outwardly from the hinge pin 43 and rotates with the hinge pin 43. A third vertical slot 50 extends upwardly from the lower edge of the locking blade 44, the purpose of which is described below. The vertical slot 50 divides the lower edge of the locking blade 44 into an inner edge portion 52 and an outer edge portion 54. The inner edge portion 52 is concave-shaped.

The locking post 46 is attached to, and extends downward from, the outer edge portion 54 of the locking blade 44. The locking post 46 may be oriented along a vertical axis parallel an axis of the hinge pin 43. The locking post 46 couples with the floor-mounted component 12 when the locking assembly 18 is shifted to its locked position, as described in more detail below. An exemplary embodiment of the locking post 46 is hexagonal in cross-section, 0.625" wide at its base, and 3.75" tall. The locking post 46 may have other cross-sectional shapes including geometric shapes such as circular, oval, triangular, rectangular, square, pentagonal, and so forth. The shape and size of the locking post 46 prevents it from rotating in the floor-mounted component 12 and provides a solid anchor against inward or outward force exerted on the door by an attacker or intruder as described in more detail below.

The floor-mounted component 12 mounts to the floor in front of the door-mounted component 10. An embodiment of the floor-mounted component 12 comprises a floor plate 56 with a hexagonal-shaped slot 58 for receiving the end of the hexagonal-shaped locking post 46 when the locking assembly 18 is shifted to its locked position. An embodiment of the floor plate 56 is square-shaped with angled, beveled edges and is approximately 3.875" long and wide, but it may be of any size and shape. The floor plate 56 includes a pair of bolt holes 60 for receiving screws or other fasteners. The floor plate 56 is also preferably fabricated of stainless steel or other hardened metals.

To install the supplemental door lock, the locking assembly 18 is placed between the door mounting plate 14 and the hinge plate 16, and the assembled components are then fastened to the inside face of a door by driving screws or other fasteners through the aligned holes 24, 40. The floor plate 56 is then attached to a floor area in front of the door-mounted components by driving screws or other fasteners through the holes 60 in the plate. In addition, a hole in the floor that aligns with the slot 58 must be drilled. These steps may of course be reversed so that the floor-mounted component 12 is installed before the door-mounted component 10.

In use, the supplemental door lock may be shifted between an unlocked position in which the door may freely open (if no other locks or latches are deployed) and a locked position to prevent opening of the door from the outside. FIG. 1 shows the locking assembly 18 in its unlocked position in which the hinge pin 43 has been vertically raised and the hinge pin 43 and locking blade 44 have been rotated counter-clockwise such that locking blade 44 rests over the support arm 42 on the hinge plate 16. Referring to FIG. 2, to shift the locking assembly 18 to its locked position, the locking blade 44 and hinge pin 43 are raised to lift the locking blade 44 off the support arm 42. The hinge pin 43 and locking blade 44 are then rotated clockwise until the locking blade 44 is generally perpendicular to the door. The hinge pin 43 and locking blade 44 are then lowered until the locking post 46 enters the slot 58 in the floor plate 56. As the locking blade 44 is lowered, the funnel-shaped groove 36 in the hinge plate 16 guides and centers the locking blade 44 until the tab 48 of the locking blade 44 enters the vertical slot 38 at the bottom of the funnel-shaped groove 36. In addition to guiding and centering the locking blade 44, the vertical slot 38 prevents the locking blade 44 from rotating when the locking blade 44 is in its lowermost position. Furthermore, when the locking assembly 18 is in the locked position, the bottom of the hinge pin 43 may rest on the foot 26 of the door mounting plate 14 in order to prevent the hinge pin 43 from extending into the gap between the door and the floor. (Ensuring that the gap between the door and the floor is unimpeded is important when security personnel are trying to unlock the supplemental door lock from the other side of the door after the emergency or crisis is over.) These steps may then be performed in reverse order to shift the supplemental door lock back to its unlocked position.

The above described supplemental door lock has numerous advantages. For example, the enlarged hexagonal shape of the locking post 46 and corresponding floor plate slot 58 prevent the hinge pin 43 and locking blade 44 from rotating when the supplemental door lock is shifted to its locked position. This keeps the locking blade 44 perpendicular to the door where it provides the maximum protection against inward or outward pressure on the door exerted by an attacker on the exterior side of the door.

Additionally, the funnel-shaped groove 36 in the hinge plate 16 guides and centers the locking blade 44 such that the locking post 46 finds its "home" in the corresponding slot 58 in the floor plate 56 without requiring a user to align the locking post 46 and slot 58. In fact, a user can simply lift the locking blade 44 off the support arm 42, rotate the locking blade 44 clockwise, and then drop it into the funnel-shaped slot 36 without further alignment. The vertical slot 38 at the bottom of the funnel-shaped slot 36 also cooperates with the tab 48 to prevent the hinge pin 43 and locking blade 44 from rotating when the supplemental door lock is shifted to its locked position. This further assists with keeping the locking blade 44 perpendicular to the door where it provides the maximum protection against inward or outward pressure on the door exerted by an attacker on the exterior side of the door.

In another embodiment of the invention, several of the above-described supplemental door locks may be integrated with electronic and computer elements to form an alert system 200 to alert others, such as security personnel, building administrators, law enforcement authorities, etc., when any of the supplemental door locks have been activated. An embodiment of the alert system 200 is shown schematically in FIGS. 5 and 6 and comprises a number of switch assemblies 202, each mounted on or near one of the supplemental door locks, a remote server 204, a number of alarms 206, and a communication network 208. The alert system 200 may also include other conventional computer and communications equipment.

Components of an exemplary switch assembly 202 are shown in FIG. 6 and include a switch 210, a communication element 212, an LED light or other indicator 214, and a battery 216 or other power source for the other components of the switch assembly.

The switch 210 senses when the locking blade 44 of its corresponding supplemental door lock is moved or otherwise shifted out of its unlocked position. The switch 210 may be a magnetic or mechanical type switch. In one embodiment, the switch 210 contacts the bottom of its locking blade 44 so as to sense when the locking blade 44 is lifted from its support arm 42. The switch 210 may generate an electronic signal and/or electronic or digital data to indicate the status of the locking blade 44, wherein the signal may have a first level or the data may have a first value when the locking blade 44 is in the unlocked position, and the signal may have a second level or the data may have a second value when the locking blade 44 is in the locked position. Each switch 210 may further have a unique identification name or number that is included in the electronic signal or data which identifies the switch 210.

The communication element 212 is electronically coupled with the switch 210 and receives the status electronic signal and/or data from the switch 210. In turn, the communication element 212 generates and sends a wireless signal or data that corresponds to the electronic signal and/or data and includes an identification of the switch 210 to the server 204 over the communication network 208 either to indicate the status of the supplemental door lock or when the switch 210 senses movement of its corresponding supplemental door lock. Each communication element 212 may include signal or data transmitting and receiving circuits, such as antennas, amplifiers, filters, mixers, oscillators, digital signal processors (DSPs), and the like. Each communication element may establish communication wirelessly by utilizing RF signals and/or data that comply with communication standards such as cellular 2G, 3G, 4G, or 5G, IEEE 802.11 standard such as WiFi, IEEE 802.16 standard such as WiMAX, Bluetooth™, or combinations thereof. Alternatively, or in addition, each communication element may establish communication through connectors or couplers that receive metal conductor wires or cables which are compatible with networking technologies such as ethernet.

The indicator 214 indicates the status of the switch 210 and hence the corresponding supplemental door lock. The indicator 214 may be an LED light or other visual and/or audible indicator. In one embodiment, the indicator 214 emits a red light to indicate the supplemental door lock has been deployed to a locked position and a green LED light to indicate the supplemental door lock is in its unlocked position. The indicator 214 may also alert occupants of a room to lock their supplemental door lock. For example, when any supplemental door lock is shifted to its locked position, the server 204 receives a signal from the corresponding switch assembly 202 and may then send warning signals to all other switch assemblies 202 in the vicinity of the triggered lock. The warning signal may cause the indicators 214 on all the switch assemblies to rapidly flash in a red color so the occupants know to engage their supplemental door locks.

Each switch assembly 202 may also be equipped with a memory device to store use data such as the number of times each supplemental door lock is activated. Such use data may also be generated and stored by the server.

The server 204 communicates with all the switch assemblies 202 and sends signals to emergency personnel when any of the switch assemblies 202 senses lock activation to alert them of emergency situations. The signals sent from each switch assembly 202 to the server 204 and the signals from the server 204 to the emergency personnel may identify the location of the triggered switch 210 and hence the door to which the supplemental door lock is attached to assist emergency personnel in locating the locked door.

The server 204 may be embodied by any number of application servers, database servers, file servers, web servers, or the like, or combinations thereof. The server 204 may be configured to include or execute software such as file storage applications, database applications, email or messaging applications, web server applications, or the like, in addition to and/or in conjunction with the pay application software described herein. The server 204 may apply business methods or algorithms, may utilize lookup tables or databases, receive user input via one or more peripheral devices or associated systems, or perform other tasks.

The alarms 206 may be any audible and/or visual alarms and may be positioned throughout a building and/or elsewhere. The alarms 206 may be triggered when any of the switch assemblies 202 senses locking of one of the supplemental door locks.

The communication network 208 allows communication between the server 204, the switch assemblies 202, and the alarms 206. The communication network 208 may include local area networks, metro area networks, wide area networks, cloud networks, the Internet, cellular networks, plain old telephone service (POTS) networks, and the like, or combinations thereof. The communication network 208 may be wired, wireless, or combinations thereof and may include components such as modems, gateways, switches, routers, hubs, access points, repeaters, towers, and the like. For example, the switch assemblies 202 may generally communicate with the server 204 wirelessly, such as radio frequency (RF) communication using wireless standards such as cellular 2G, 3G, 4G, or 5G, Institute of Electrical and Electronics Engineers (IEEE) 802.11 standards such as WiFi, IEEE 802.16 standards such as WiMAX, Bluetooth®, or combinations thereof.

Additional Considerations

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

Although the present application sets forth a detailed description of numerous different embodiments, the legal scope of the description is defined by the words of the claims set forth in any regular utility patent applications or other patent applications that claim priority to this provisional application. The descriptions herein are to be construed as exemplary only and do not describe every possible embodiment since describing every possible embodiment would be impractical. Numerous alternative embodiments may be implemented, using either current technology or technology developed after the filing date of this patent application, which would still fall within the scope of the claims.

Throughout this specification, plural instances may implement components, operations, or structures described as a single instance. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Certain embodiments are described herein as including logic or a number of routines, subroutines, applications, or instructions. These may constitute either software (e.g., code embodied on a machine-readable medium or in a transmission signal) or hardware. In hardware, the routines, etc., are tangible units capable of performing certain operations and may be configured or arranged in a certain manner. In example embodiments, one or more computer systems (e.g., a standalone, client or server computer system) or one or more hardware modules of a computer system (e.g., a processor or a group of processors) may be configured by software (e.g., an application or application portion) as computer hardware that operates to perform certain operations as described herein.

In various embodiments, computer hardware, such as a processing element, may be implemented as special purpose or as general purpose. For example, processing elements may comprise dedicated circuitry or logic that is permanently configured, such as an application-specific integrated circuit (ASIC), or indefinitely configured, such as an FPGA, to perform certain operations. The processing elements may also comprise programmable logic or circuitry (e.g., as encompassed within a general-purpose processor or other programmable processor) that is temporarily configured by software to perform certain operations. It will be appreciated that the decision to implement the processing element as special purpose, in dedicated and permanently configured circuitry, or as general purpose (e.g., configured by software) may be driven by cost and time considerations.

Accordingly, the term "processing element" or equivalents should be understood to encompass a tangible entity, be that an entity that is physically constructed, permanently configured (e.g., hardwired), or temporarily configured (e.g., programmed) to operate in a certain manner or to perform certain operations described herein. Considering embodiments in which the processing element is temporarily configured (e.g., programmed), each of the processing elements need not be configured or instantiated at any one instance in time. For example, where a processing element comprises a general-purpose processor configured using software, the general-purpose processor may be configured as respective different processing elements at different times. Software may accordingly configure the processing element to constitute a hardware configuration at one instance of time and to constitute a different hardware configuration at a different instance of time.

Computer hardware components, such as communication elements, memory elements, processing elements, and the like, may provide information to, and receive information from, other computer hardware components. Accordingly, the described computer hardware components may be regarded as being communicatively coupled. Where multiple of such computer hardware components exist contemporaneously, communications may be achieved through signal transmission (e.g., over appropriate circuits and buses) that connect the computer hardware components. In embodiments in which multiple computer hardware components are configured or instantiated at different times, communications between such computer hardware components may be achieved, for example, through the storage and retrieval of information in memory structures to which the multiple computer hardware components have access. For example, one computer hardware component may perform an operation and store the output of that operation in a memory device to which it is communicatively coupled. A further computer hardware component may then, later, access the memory device to retrieve and process the stored output. Computer hardware components may also initiate communications with input or output devices, and may operate on a resource (e.g., a collection of information).

Unless specifically stated otherwise, discussions herein using words such as "processing," "computing," "calculating," "determining," "presenting," "displaying," or the like may refer to actions or processes of a machine (e.g., a computer with a processing element and other computer hardware components) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112(f) unless traditional means-plus-function language is expressly recited, such as "means for" or "step for" language being explicitly recited in the claim(s).

Although the technology has been described with reference to the embodiments illustrated in the attached drawing figures, it is noted that equivalents may be employed and substitutions made herein without departing from the scope of the technology as recited in the claims.

Having thus described various embodiments of the technology, what is claimed as new and desired to be protected by Letters Patent includes the following:

1. A door lock notification system for a plurality of doors in a building comprising:

a) a plurality of door locks wherein the door locks comprise a locking post oriented along a vertical axis which extends from an upper position to a lower locked position wherein the locking post locks by insertion of the locking post in a floor mounted component in the floor;

b) a plurality of electronic devices associated with each of the plurality of door locks, wherein each electronic device detects if each door is locked or unlocked;

c) a communication element for each of the plurality of door locks transmitting an electronic signal indicating if each door is locked or unlocked, wherein each communication element has a unique identification name or number;

d) an indicator on each of the plurality of door locks to indicate if each of the door locks is locked or unlocked; and e) a device which receives each of the communication elements signal and produces a list of the status of each door lock.

2. The door lock notification system for a plurality of doors in a building according to claim 1 wherein the communication element sends a signal to at least one of security personnel, building administrators, and law enforcement authorities.

* * * * *